US005682628A

United States Patent [19]

Oleson

[11] Patent Number: 5,682,628

[45] Date of Patent: Nov. 4, 1997

[54] FLUSHABLE BATHTUB CLEANING SYSTEM

[76] Inventor: Vicki L. Oleson, 5735 17th Ave. N., St. Petersburg, Fla. 33710

[21] Appl. No.: 644,750

[22] Filed: May 10, 1996

[51] Int. Cl.[6] ..... A47K 3/02

[52] U.S. Cl. ..... 4/591; 4/559

[58] Field of Search ..... 4/538, 559, 591, 4/546, 662

[56] References Cited

U.S. PATENT DOCUMENTS

| | | | |
|---|---|---|---|
| 1,438,373 | 12/1922 | Gould | 4/591 |
| 4,383,341 | 5/1983 | Altman | 4/662 |
| 4,868,934 | 9/1989 | Altman | 4/662 |
| 5,012,535 | 5/1991 | Klotzbach | 4/541.4 X |
| 5,381,566 | 1/1995 | Sonesson et al. | 4/591 |

FOREIGN PATENT DOCUMENTS

| | | | |
|---|---|---|---|
| 0201451 | 8/1923 | United Kingdom | 4/591 |

*Primary Examiner*—Charles E. Phillips

*Attorney, Agent, or Firm*—American Innovations, Inc.; Dorothy S. Morse, Esq.

[57] ABSTRACT

A bathtub cleaning system which does not store used bathtub water in a separate chamber, but instead draws the used water from the bathtub after use and mixes it with a cleaning solvent, thereafter distributing it to nozzles positioned around the top edge of the bathtub for flushable cleaning of the bathtub walls and floor without scrubbing. Applications may include, but are not be limited to, use in residences, hotels, hospitals, nursing homes, college dormitories, and campground facilities to reduce the labor and amount of fresh water required to clean bathtubs. The bathtub cleaning system is also contemplated for use by persons with limited mobility, such as infirm, overweight, physically challenged, and elderly persons.

18 Claims, 3 Drawing Sheets

FLUSHABLE BATHTUB CLEANING SYSTEM

BACKGROUND—FIELD OF INVENTION

This invention relates to cleaning systems which use recycled water, specifically to a bathtub cleaning system which does not store used bathtub water in a separate chamber, but instead draws the used water from the bathtub after use and mixes it with a cleaning solvent, thereafter distributing it to nozzles positioned around the top edge of the bathtub for flushable cleaning of the bathtub wails and floor without scrubbing. Applications may include, but are not be limited to, use in residences, hotels, hospitals, nursing homes, college dormitories, and campground facilities to reduce the labor and amount of fresh water required to clean bathtubs. The bathtub cleaning system is also contemplated for use by persons with limited mobility, such as infirm, overweight, physically challenged, and elderly persons.

BACKGROUND—DESCRIPTION OF PRIOR ART

Soap films, hard water deposits, skin cells, body oils, hair, and other debris are left on the surfaces of a bathtub after a person bathes and must be periodically removed to keep the bathtub in a sanitary condition for subsequent use. Should they not be removed, they create a growth medium for molds, fungus, and other undesirable organisms. Ideally, for optimum sanitation, a bathtub should be cleaned after every use. However, cleaning a bathtub by hand can be strenuous work. Considerable bending over and stretching must be done by a person to reach all of the surfaces of the bathtub which require cleaning. Further, since the bathtub walls are necessarily low to the ground and made of rigid material, it is often awkward or impossible for some people, particularly those who are infirm, overweight, elderly, or physically challenged in other ways, to bend over them to properly clean them. Even spray-on products which advertise that they require no scrubbing and rinsing, may require wiping with a cloth, which again requires the bending and stretching which some people find difficult to perform.

In addition, many cleaning products contemplated for use by hand leave slippery residues and need to be thoroughly rinsed with water after application. As a result, proper scrubbing and adequate rinsing of a bathtub, with a frequency needed to keep it in optimum sanitary condition, requires considerable labor and water expense. In answer to growing environmental concerns about dwindling fresh water supplies, it would be desirable if some or all of the water used for such bathtub cleaning came from recycled sources. Commercial facilities such as hotels, nursing homes, college dormitories, and hospitals, have many bathtubs which are in need of frequent cleaning to meet health regulations. As a result, a significant portion of their cleaning expense is devoted to labor and water for keeping bathtubs clean. Added to such expense, commercial facilities often encounter difficulties in finding and keeping reliable labor. Therefore an automatic bathtub cleaning system, particularly one that would use recycled water, would be useful in reducing both labor and water expenses incurred by commercial facilities in keeping their bathtubs clean.

It is known for people in arid regions, or areas having remote water supplies, to recycle water more frequently than people living in areas having abundant water. Water used for one purpose, such as washing dishes, bathing, washing clothes, and food preparation, is diverted for other uses, including the flushing of toilets and the irrigation of outdoor plants. Often, in less industrialized nations, such recycling is done by hand. The invention disclosed in U.S. Pat. No. 5,317,766 to McDonald discloses a portable, retrofittable water recycle system for the collection, storage, and reuse of tub, shower and sink water to flush toilets. Capacity of the McDonald system is increased by adding more storage tank modules which are sized and shaped to fit inside a sink cabinet. In contrast with the present invention, the McDonald system is cumbersome in that storage adjacent to the toilet must be available for the collection of used water from other bathroom fixtures. In contrast, the present invention has no storage tank and involves the immediate mixing of used bathtub water with a cleaning solvent, with subsequent routing of that mixture to nozzles around the top edge of the bathtub where it is sprayed on the walls and the floor of the bathtub to flushably clean them, and whereafter it is evacuated from the bathtub and discharged into a drain.

The invention in U.S. Pat. No. 5,313,677 to Coe (1994) also discloses a system for diverting used bathtub water for other uses, such as to irrigation sprinklers or making it available through an outdoor faucet. Although the Coe invention addresses the environmental concerns of recycling bathtub water, which are also addressed by the present invention, the Coe invention does not provide means to reduce labor involved in the cleaning of bathtubs. The prior art which appears to most closely resemble the present invention is the invention disclosed in U.S. Pat. No. 4,383,341 to Altman (1983). However, there are several significant differences between the Altman invention and the present invention. The Altman invention comprises a series of pop-out nozzles which are positioned in a confining wall above the upper edges of the bathtub. The present invention has fixed nozzles positioned in a track around the top edge of a bathtub and attached to flexible tubing which is retractable for maintenance and storage. In addition, three chambers are used by the Altman invention, one to store a quantity of cleaning concentrate, a second to store a diluent, and a third to act as a mixing chamber. In contrast, the present invention has only one chamber which stores a quantity of cleaning solvent. The diluted cleaning concentrate in the Altman invention is sprayed through the nozzles, after which only diluent is sprayed as a rinse. In contrast, the present invention is flushable and is cleaned in one step after the used water leaves the bathtub. Therefore it may be seen that the Altman invention is cumbersome and time consuming to use, as compared to the present invention. It is not known to have a bathtub cleaning system which does not store used bathtub water in a separate chamber, but instead draws the used water from the bathtub after use and mixes it with a cleaning solvent, thereafter distributing it to nozzles positioned around the top edge of the bathtub for flushable cleaning of the bathtub walls and floor without scrubbing.

SUMMARY OF INVENTION—OBJECTS AND ADVANTAGES

It is the primary object of this invention to provide a bathtub washing system which uses recycled bathtub water mixed with a cleaning solvent for the purposes of water conservation and reduced cost of use. It is also an object of this invention to provide a bathtub washing system which does not store the used water but immediately uses it in a flushable manner. A further object of this invention is to provide a bathtub washing system which has nozzles attached to a track which allows easy access for maintenance and care. It is also an object of this invention to provide a bathtub washing system which has a sturdy top lip over the nozzles to provide additional support and potential assistance for a person entering and exiting from the bathtub. A further object of this invention is to provide a bathtub washing system which is simply operated and easy to use.

As described herein, properly manufactured and installed in a bathtub, the present invention would provide a flushable system for cleaning the bathtub with used bathtub water mixed with a cleaning solvent. The bathtub water is not stored in a remote chamber for later use, but is mixed with cleaning solvent immediately after it leaves the bathtub and directed through nozzles positioned in a track around the top edge of the bathtub providing an overlapping jet spray to flushably clean the walls and the floor of the bathtub. After cleaning, the used water and the cleaning solvent mixture would be evacuated from the bathtub and into a drain. A drain transfer lever is employed to activate a drain by-pass valve to allow the used bathtub water to enter the cleaning system. When water enters the system, a water sensor turns on a pump which causes the used bathtub water to be mixed with cleaning solvent stored in a reservoir, then distributed through tubing in a track around the top edge of the bathtub to the nozzles. An over lip reinforced with support bars provides protection to the nozzles, and more importantly provides an aid to people entering and exiting from the bathtub. When the water sensor which turned on the pump senses that enough water has been diverted to adequately clean the bathtub, the water sensor closes the drain by-pass valve so that remaining used bathtub water, and the used bathtub water and cleaning solvent mixture, are evacuated to a drain. Use of the present invention has an environmental benefit as it recycles used water instead of employing fresh water for the bathtub cleaning task. The present invention also has a cost saving benefit in terms of time and utility billings for fresh water. The present invention retrofits to existing plumbing, gravity drains, and has a smooth, safe-edged lip which may be made out of cast iron, steel or fiberglass. The present invention is easy to use, simple and convenient to operate as it only involves the movement of a single lever to start the flushable cleaning process, and provides superior sanitation since it is easy to perform after each bathtub use. For use by infirm, overweight, physically challenged, and elderly persons who may not be able to easily bend over to activate the drain transfer lever, it is contemplated for remote means to be used for system activation, such as a remote switch.

The description herein provides preferred embodiments of the present invention but should not be construed as limiting the scope of the flushable bathtub invention. Variations in the number of nozzles used, the number of support bars attached to the lip, the type of cleaning solvent used, the type of water sensor used, the type of tubing used, the size of the pump used, the configuration of the reservoir used to store the cleaning solvent, and the size and configuration of the tub drain lever used, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
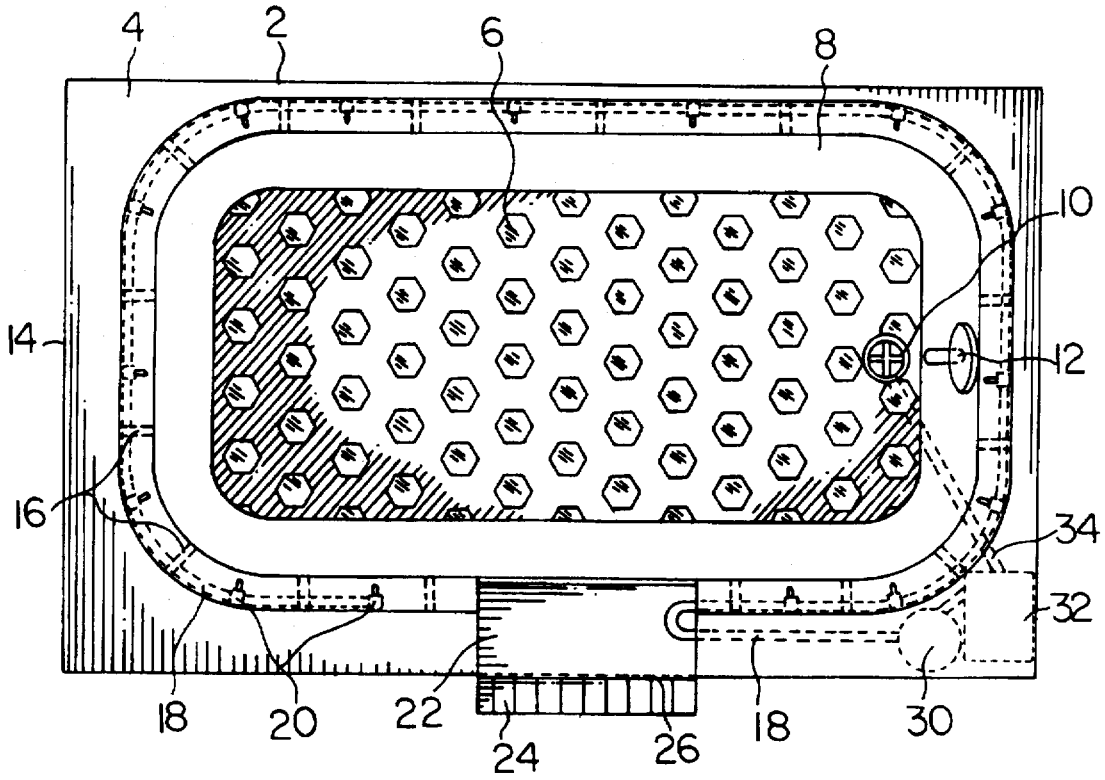
FIG. 1 is a top view of the invention installed on a bathtub.

FIG. 1 shows a preferred embodiment of the present invention adapted for use with a conventional bathtub 2 having a tub top 4, a tub bottom, tub walls 8, and a tub drain hole 10. Although it is contemplated for the present invention to be connected to conventional bathtubs 2 having standard five feet by thirty inch by fourteen inch dimensions, which may be either right hand or left hand fixture accessible, it is also contemplated for the present invention to be connected to non-conventional bathtubs 2. FIG. 1 shows the present invention having a tube 18 positioned around the upper edge of tub walls 8. It is contemplated for tube 18 to be flexible so as to be retractable and made of materials which are resistant to cleaning solvents. A lip 14 is attached to the top surface of bathtub 2 and positioned over tube 18 to provide support for a user entering and exiting from bathtub 2. It is contemplated for lip 14 to be sturdy and able to support large loads, such as the weight of a person attempting to enter or exit from bathtub 2. In the preferred embodiment it is contemplated for lip 14 to be made of cast iron, steel, or fiberglass. FIG. 1 also shows the present invention having an access area 22 on one side of bathtub 2 into which tube 18 may be retracted for maintenance and care, a cover 24 positioned over access area 22, and hinges 26 connected between access area 22 and cover 24 so that cover 24 may be lifted for access to access area 22.

In addition, FIG. 1 shows a plurality of nozzle supporting units 20 attached to tube 18. A plurality of support bars 16 are also attached to the underside portion of lip 14 to strengthen and add support to lip 14. FIG. 1 also shows the distal end of tube 18 connected beneath tub top 4 to a reservoir 30. It is contemplated for reservoir 30 to hold a cleaning solvent (not shown) for mixing with used bathtub water (not shown) for use in cleaning bathtub 2. A pump 32 is also located under tub top 4, adjacent to reservoir 30. A drain transfer lever 12 connected through tub wall 8 is used to initiate the flushable cleaning process and allow used bathtub water (not shown) to exit bathtub 2 and be diverted through pump 32, mixed with cleaning solvent (not shown) from reservoir 30, and fed through tube 18 to be sprayed from nozzles, shown in FIG. 5 as number 44, in overlapping water patterns onto bathtub walls 8 and bathtub bottom 6 after which gravity causes the water and the cleaning solvent mixture to be evacuated from bathtub 2 through tub drain hole 10.

Figure 2:
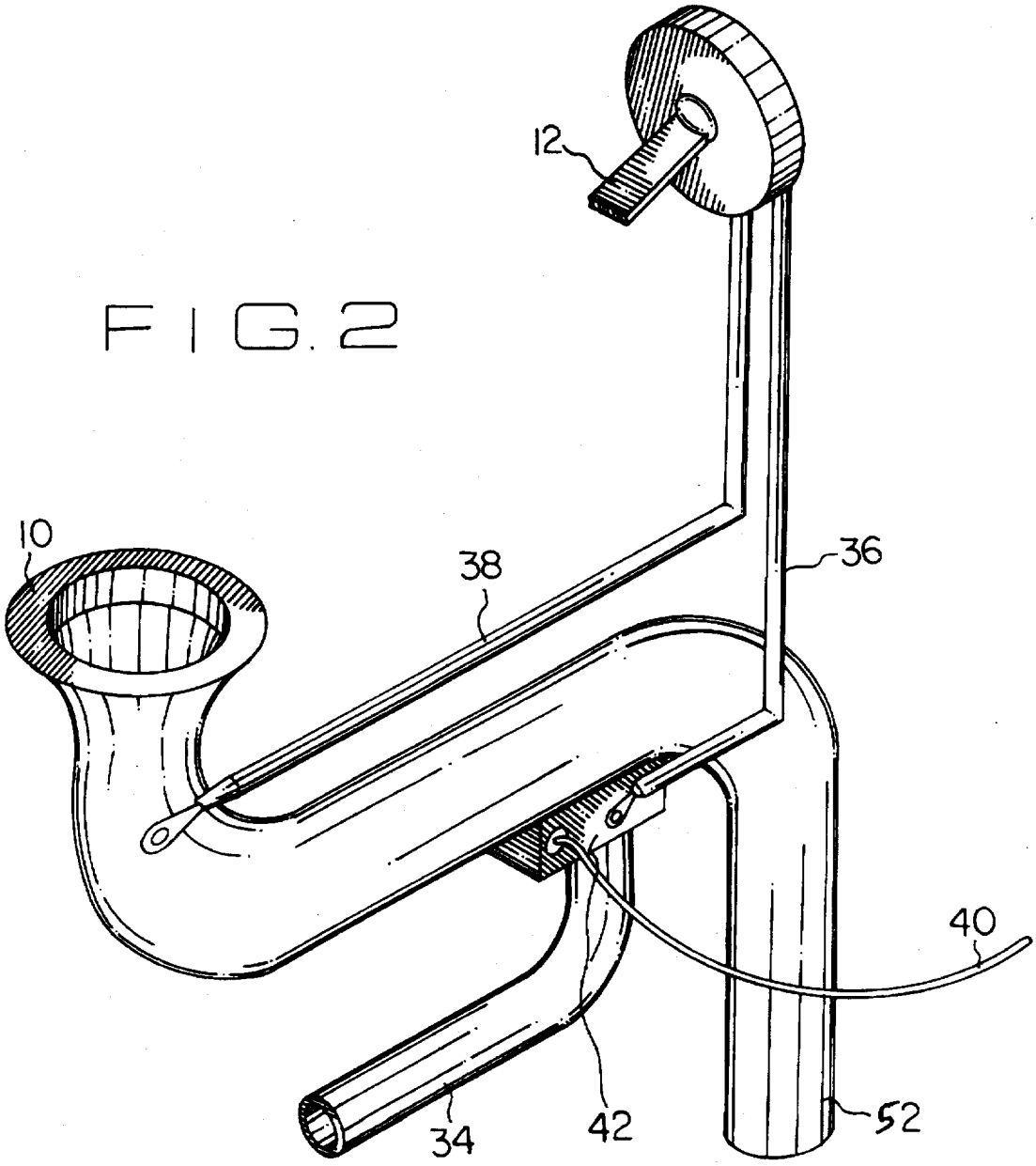
FIG. 2 is an isometric view of some of the plumbing of the invention connected to existing bathtub plumbing.

FIG. 2 shows drain transfer lever 12 being attached to one end of a valve linkage 36, the other end of valve linkage 36 being attached to drain by-pass valve 42. One end of a water sensor 40 is connected to drain by-pass valve 42, the other end of water sensor 40 being connected to pump 32 to activate it when water is diverted past water sensor 40 and into a water line 34 leading to pump 32. FIG. 2 also shows drain transfer lever 12 being attached to one end of a drain linkage 38, the other end of drain linkage 38 being attached to tub drain hole 10 which connects to drain 52. When the present invention is not in use, used water flowing from bathtub 2 enters tub drain hole 10 and is evacuated through drain 52. When the present invention is employed to clean bathtub 2 after a person has bathed and used bathtub water (not shown) still remains in bathtub 2, drain transfer lever 12 is moved into a position to cause both drain linkage 38 to open tub drain hole 10 and valve linkage 36 to open drain by-pass valve 42 so that the used bathtub water entering bathtub drain hole 10 is diverted through drain by-pass valve 42 and into water line 34 instead of being allowed to enter drain 52. In the preferred embodiment it is contemplated for the movement of drain transfer lever 12 to be performed manually, either directly with one's fingers or with an elongated tool (not shown) which engages drain transfer lever 12. Also, although not shown, this movement may be accomplished through the use of a remote switch or a timer. As water flows past drain by-pass valve 42 into water line 34, water sensor 42 sends a signal to pump 32 to activate it. The used bathtub water is then mixed with cleaning solvent (not shown) housed in reservoir 30 and forced through tube 18 and nozzles 44 back into bathtub 2. When water sensor 40 has determined that enough used water (not shown) has entered into water line 34, it causes drain by-pass valve 42 to close and pump 32 to cease to function, thereby allowing the remaining water in bathtub 2 to be evacuated through drain 52.

Figure 3:
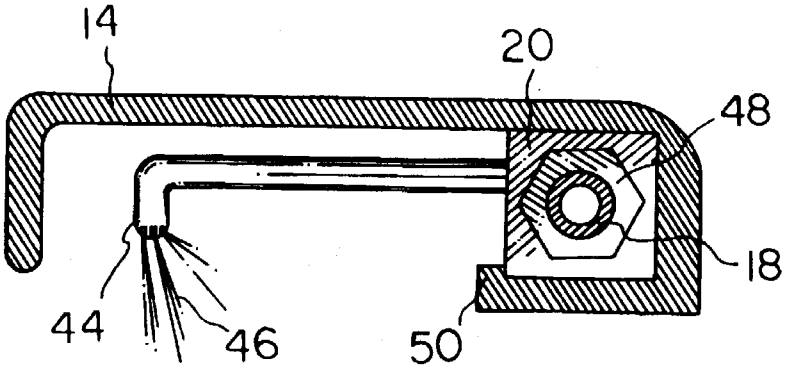
FIG. 3 is a sectional view of a nozzle unit of the invention.

FIG. 3 shows lip 14 having a rounded, safe-edged upper surface with one end of the upper surface of lip 14 depending downward to cover nozzle 44 and the other end of the upper surface of lip 14 depending downwardly to define a track within which nozzle support units 20 are able to move. The free end of the upper surface of lip 14 defining the track curves back on itself to form a folded edge 50 to securely retain nozzle support units 20 within the track during use. FIG. 3 also shows tube 18 positioned through nozzle support unit 20 and a hose nut 48 securing nozzle support unit 20 and nozzle 44 to tube 18 so that nozzle support unit 20 and nozzle 44 may be easily released from tubing 18 for cleaning and replacement. FIG. 3 also shows a used bathtub water and cleaning solvent mixture 46 being sprayed from nozzle 44. In the preferred embodiment, it is contemplated for the present invention to comprise an adequate number of nozzles 44 to entirely blanket bathtub wails 8 and bathtub bottom 6 with used bathtub water and cleaning solvent mixture 46 during the cleaning process.

Figure 5:
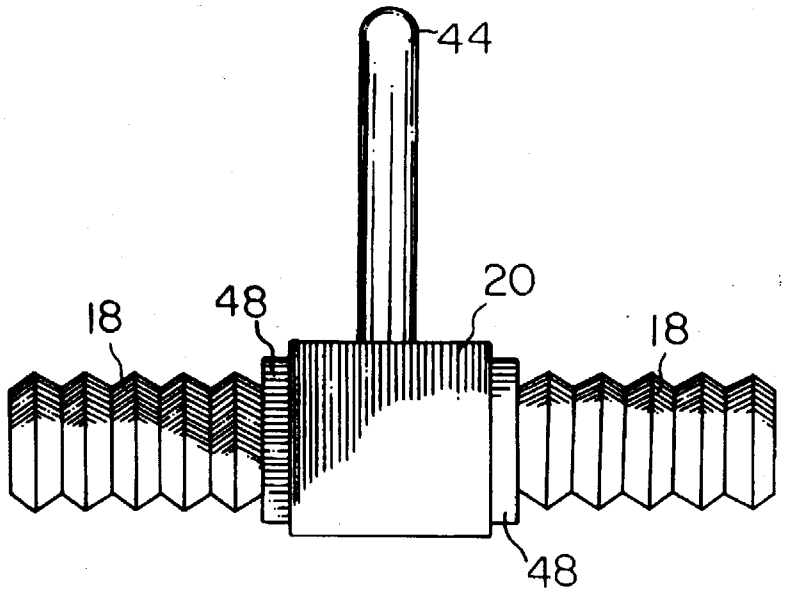
FIG. 5 is a top view of the nozzle and tube assembly of the invention.
Figure 4:
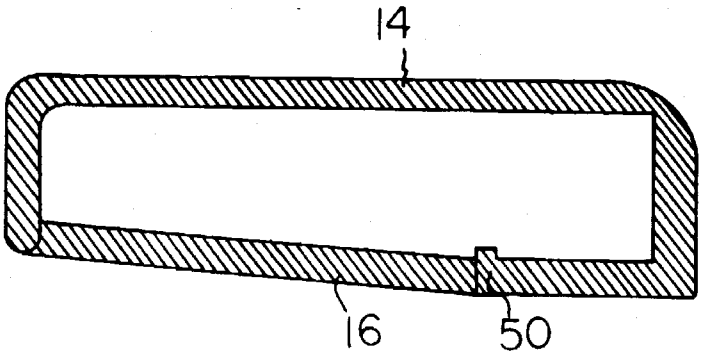
FIG. 4 is a sectional view of the nozzle support unit of the invention.

FIG. 4 shows support bar 16 connected between the downward depending end of lip 14 coveting nozzle 44 and folded edge 50. It is contemplated for support bar 16 to be made of a strong material to add strength and rigidity to lip 14. In the preferred embodiment it is contemplated for support bars 16 to be made from the same materials used for lip 14, for support bars 16 to be welded to lip 14, and for the present invention to comprise an adequate number of support bars 16 to add sufficient strength to lip 14 so that lip 14 may support the weight of a person entering and exiting from bathtub 2. FIG. 5 shows tubing 18 connected to both sides of nozzle support unit 20 by hose nuts 48, with nozzle 44 also attached to nozzle support unit 20 at right angles to tube 18.

Although not shown, when retrofitting the present invention onto bathtub 2, it is contemplated for four alterations to be made to bathtub 2. First, a cleaning solvent dispensing system comprising reservoir 30, nozzles 44, tube 18, lip 14, indicating means for refilling reservoir 30, and means to calibrate mixing of the used bathtub water and the cleaning solvent must be installed in and around the upper edges of tub walls 8. Second, access area 22 must be installed, with hinges 26 attaching cover 24 over access area 22 to provide access to nozzles and allow for refilling of reservoir 30. Third, a pump must be installed to force the used bathtub water and cleaning solvent mixture through nozzles 44 and a remote switch, timer, or other means to allow multiple cycles, may also be added, such switches and timers being mounted the minimum distances away from bathtub 2 necessary to conform to safety codes. Fourth, drain transfer lever 12, drain by-pass valve 42, water sensor 40, valve linkage 36, tub drain linkage 38, and water line 34 must be installed to divert used bathtub water from drain 52.

What is claimed is:

1. A flushable cleaning system for a bathtub comprising a tub top, a tub bottom, tub walls having an upper edge, and a tub drain hole connected to a drain, which employs a mixture of used bathtub water and a cleaning solvent to clean said tub bottom and said tub walls, said flushable cleaning system comprising a lip positioned around said upper edge of said tub walls, said lip having an underside portion and a track defined in said underside portion; a hollow tube being flexible so as to be retractable, said tube also being made of materials resistant to said cleaning solvent, said tube disposed within said track; a plurality of nozzles for use in spraying said mixture on said tub walls; supporting means to support said nozzles and said tube within said track; a drain by-pass valve; a drain transfer lever connected to said tub drain hole and also to said drain by-pass valve, said drain transfer lever movable between a first position opening both said drain by-pass valve and said tub drain hole, and a second position closing said drain by-pass valve; a pump; a reservoir for holding said cleaning solvent; a water line connecting said drain by-pass valve to said pump; and a water sensor so that when said used bathtub water is in said bathtub and said drain transfer lever is moved into said first position said used bathtub water enters said tub drain hole and is diverted through said drain by-pass valve, into said water line, through said pump, mixed with said cleaning solvent, moved through said tube, and into said nozzles where said mixture is sprayed onto said tub wails and said tub bottom, said water sensor activating said pump when said used bathtub water flows past said drain by-pass valve, said water sensor also determining when enough of said used bathtub water has moved through said drain by-pass valve and closing said drain by-pass valve and deactivating said pump allowing said mixture in said bathtub to leave through said tub drain valve and be evacuated through said drain.

2. The flushable cleaning system of claim 1 further comprising a storage area communicating with said track, said storage area having a hollow interior of adequate size and configuration to allow said tube, said nozzle support units, and said nozzles to be tracked within said hollow interior, said flushable cleaning system also comprising a cover and a plurality of hinges attached between said access area and said cover to provide access to said tubes, said nozzles, said cleaning solvent reservoir, and said pump.

3. The flushable cleaning system of claim 1 wherein said supporting means comprises a plurality of nozzle support units, one of said nozzles connected to each of said nozzle support units, a plurality of hose nuts to connect said nozzle support units and said nozzles to said tube, and a folded edge on said underside portion of said lip to engage each of said nozzle support units.

4. The flushable cleaning system of claim 3 further comprising a plurality of support bars to provide strength and support to said lip so that said lip is able to support the weight of a person entering and exiting from said bathtub, each of said support bars connected to said underside portion of said lip.

5. The flushable cleaning system of claim 1 further comprising remote activation means for moving said drain transfer lever into said first position.

6. The flushable cleaning system of claim 5 wherein said remote activation means comprises a remote switch and means to connect said remote switch to said drain transfer lever.

7. The flushable cleaning system of claim 5 wherein said remote activation means comprises a timer and means to connect said timer to said drain transfer lever.

8. The flushable cleaning system of claim 5 wherein said remote activation means comprises an elongated tool having means to engage and move said drain transfer lever into said first position.

9. A flushable cleaning system for a bathtub comprising a tub top, a tub bottom, tub walls having an upper edge, and a tub drain hole connected to a drain, which employs a mixture of used bathtub water and a cleaning solvent to clean said tub bottom and said tub walls, said flushable cleaning system comprising a lip positioned around said upper edge of said tub walls, said lip having an underside portion and a track defined in said underside portion; a hollow tube being flexible, said tube also being made of materials resistant to said cleaning solvent, said tube disposed within said track; a plurality of nozzle support units attached to said tube; a plurality of nozzles for use in spraying said mixture on said tub walls, one of said nozzles connected to each of said nozzle support units; means to connect said nozzle support units and said nozzles to said tube; a drain by-pass valve; a drain transfer lever connected to said tub drain hole and also to said drain by-pass valve, said drain transfer lever movable between a first position opening both said drain by-pass valve and said tub drain hole, and a second position dosing said drain by-pass valve; a pump; a reservoir for holding said cleaning solvent; a water line connecting said drain by-pass valve to said pump; and a water sensor so that when said used bathtub water is in said bathtub and said drain transfer lever is moved into said first position said used bathtub water enters said tub drain hole and is diverted through said drain by-pass valve, into said water line, through said pump, mixed with said cleaning solvent, moved through said tube, and into said nozzles where said mixture is sprayed onto said tub walls and said tub bottom, said water sensor activating said pump when said used bathtub water flows past said drain by-pass valve, said water sensor also determining when enough of said used bathtub water has moved through said drain by-pass valve and dosing said drain by-pass valve and deactivating said pump allowing said mixture in said bathtub to leave through said tub drain valve and be evacuated through said drain.

10. The flushable cleaning system of claim 9 further comprising an access area communicating with said track, said access area having a hollow interior of adequate size and configuration to allow said tube, said nozzle support units, and said nozzles to be tracked within said hollow interior, said flushable cleaning system also comprising a cover and a plurality of hinges attached between said access area and said cover to provide access to said tubes, said nozzles, said cleaning solvent reservoir, and said pump.

11. The flushable cleaning system of claim 9 further comprising a plurality of support bars to provide strength and support to said lip so that said lip is able to support the weight of a person entering and exiting from said bathtub, each of said support bars connected to said underside portion of said lip.

12. The flushable cleaning system of claim 9 further comprising remote activation means for moving said drain transfer lever into said first position.

13. The flushable cleaning system of claim 12 wherein said remote activation means comprises a remote switch and means to connect said remote switch to said drain transfer lever.

14. The flushable cleaning system of claim 12 wherein said remote activation means comprises a timer and means to connect said timer to said drain transfer lever.

15. The flushable cleaning system of claim 12 wherein said remote activation means comprises an elongated tool having means to engage and move said drain transfer lever into said first position.

16. A method for flushably cleaning a bathtub with a mixture of used bathtub water and a cleaning solvent, said method comprising the steps of providing used bathtub water and a bathtub having a tub top, a tub bottom, tub walls having an upper edge, and a tub drain hole connected to a drain, said used bathtub water being positioned within said bathtub; also providing a lip having an underside portion and a track on said underside portion, a flexible tube, a plurality of nozzles, a plurality of nozzle support units, a drain transfer lever, a pump, a reservoir, a quantity of cleaning solvent, a drain by-pass valve, a water line, and a water sensor; installing said lip on said tub top adjacent to said upper edge of said tub walls; connecting said nozzle support units and said nozzles to said tube; installing said tube in said track; connecting said tube to said reservoir; connecting said reservoir to said pump; connecting said water line between said pump and said drain by-pass valve; connecting said water sensor between said drain by-pass valve and said pump; connecting said drain transfer lever to said drain by-pass valve and said tub drain hole; filling said reservoir with said cleaning fluid; moving said drain transfer lever into a position to open said tub drain hole said drain by-pass valve so as to divert said used bathtub water entering said bathtub drain hole through said drain by-pass valve and into said water line instead of being allowed to enter said drain; as said used bathtub water moves through said drain by-pass valve, said water sensor sending a signal to said pump to activate it; mixing said used bathtub water with said cleaning solvent to form a mixture; pumping said mixture through said tube; spraying said mixture from said nozzles onto said tub walls and said tub bottom; said water sensor determining when enough of said used bathtub water has passed through said drain by-pass valve; and when said water sensor has determined that enough of said used bathtub water has passed through said drain by-pass valve, said water sensor causing said drain by-pass valve to close and pump to cease functioning, thereby allowing said mixture in said bathtub to be evacuated through said drain.

17. The method of claim 16 further comprising the steps of also providing a plurality of support bars, and connecting said support bars to said underside surface of said lip to strengthen said lip.

18. The method of claim 16 further comprising the steps of providing remote activation means for moving said drain transfer lever to open said drain by-pass valve and said tub drain hole, providing means of connecting said remote activation means to said drain transfer lever, and connecting said remote activation means to said drain transfer lever.

* * * * *